United States Patent [19]

Holoff et al.

[11] 4,344,813

[45] Aug. 17, 1982

[54] TAPE DISPENSER

[75] Inventors: Manning Holoff, Los Angeles; James D. Riggins, N. Hollywood, both of Calif.

[73] Assignee: Manning Holoff Co., Van Nuys, Calif.

[21] Appl. No.: 216,083

[22] Filed: Dec. 15, 1980

[51] Int. Cl.[3] ..... B32B 31/18; B44C 7/00

[52] U.S. Cl. ..... 156/527; 156/576; 156/577

[58] Field of Search ..... 156/523, 527, 526, 574, 156/576, 577, 579

[56] References Cited

U.S. PATENT DOCUMENTS

| | | | |
|---|---|---|---|
| 2,582,979 | 1/1952 | Fritzinger | 156/523 |
| 2,722,329 | 11/1955 | Vogt | 156/523 |
| 3,523,053 | 8/1970 | Zbinden et al. | 156/523 |
| 3,745,086 | 7/1973 | Parker | 156/527 |
| 3,850,779 | 11/1974 | Pearson | 156/523 |
| 4,097,328 | 6/1978 | Urushizaki | 156/523 |

*Primary Examiner*—Michael G. Wityshyn
*Attorney, Agent, or Firm*—Lyon & Lyon

[57] ABSTRACT

A tape dispenser for securing a desired length of pressure sensitive tape onto a surface and severing the length from a tape roll held within the dispenser. The dispenser includes an applicator element having a tape support bar at the lower end thereof, a tape gripping member pivotally mounted on the lower end of the applicator forwardly of the tape support bar, a tape cutting edge disposed in the lower portion of the device and a spring member for raising the actuator after the desired length of tape has been paid out from the dispenser and urging the tape support bar against the tape gripping member to grip the tape therebetween and pull the tape over the cutting edge as the applicator moves upwardly within the dispenser severing the length of tape secured to the surface from the tape roll.

13 Claims, 12 Drawing Figures

TAPE DISPENSER

BACKGROUND OF THE INVENTION

The present invention relates to a tape dispensing device and more particularly, to a dispenser which allows a desired length of tape to be secured to a surface and severed from the roll held within the dispenser without the need to physically handle the tape. Almost everyone is familiar with the problems of handling pressure sensitive adhesive tape, particularly cellophane tape. In using such tape, it is necessary to manually withdraw the desired length of tape from the roll, hold the tape in such a manner that the pressure sensitive adhesive side does not come into contact with itself, sever the desired length from the roll and press the severed length onto the desired surface. In an effort to ease this task, attempts have been made to develop a dispenser which allows the user to pay out the desired length of tape directly onto the surface to be taped and sever that length which having to physically handle the tape. Heretofore, such efforts have not proven satisfactory largely due to either the complexity and expense of the device or the device's inability to provide positive control over the tape during the taping operation, resulting in unsatisfactory application. In addition, such devices often allow the severed end of the tape roll to contact or even be pressured against the surface to be taped and then be pulled from the surface as the tape is reversed. Then causes the tape end to collect fibers of the surface to which it was adhered which impairs the adhesive quality of the tape and, adversely affecting the subsequent operation of the device as the tape end will no longer properly adhere to a surface.

Examples of such devices are found in U.S. Pat. Nos. 3,523,053; 3,850,779 and 3,745,086. U.S. Pat. No. 3,523,053 exemplifies the complexity of some of the devices which have been developed, while U.S. Pat. No. 3,745,086 is illustrative of a device which fails to positively grip the tape resulting in awkward and often unsatisfactory tape application. The latter device additionally presses the severed end of the tape roll against the taped surface during application of the tape and then pulls the tape end from the surface, which can adversely affect its subsequent use.

The tape dispenser disclosed herein is of simple construction yet handles the tape under positive control in such a manner as to continuously provided smooth and reliable application of the tape while never allowing the severed end of the tape roll to contact the surface to which the tape is being applied.

SUMMARY OF THE INVENTION

Briefly, the present invention comprises a tape dispenser which holds therein a roll of pressure sensitive adhesive tape in such a manner that as the dispenser is moving over the surface to be taped with the tape gripping member deactivated, the tape is paid out of the device and pressed onto the surface. When the desired length of tape has been applied to the surface, the tape gripping mechanism is activated causing the member to grip and pull the tape across a cutting edge leaving the desired length of tape adhered in a flat disposition to the surface and securing the severed end of the tape roll within the dispenser without allowing the severed end to contact the surface.

It is the principal object of the present invention to provide a tape dispener which applies a desired length of a pressure sensitive adhesive tape to a surface without having to physically handle the tape.

It is another object of the present invention to provide a tape dispenser which applies a desired length of a pressure sensitive adhesive to a surface and severs the length of tape from the tape roll without disturbing the applied length of tape.

It is a further object of the present invention to provide a tape dispenser which applies a desired length of a pressure sensitive adhesive tape to a surface and severs the length of tape from the tape roll without allowing the severed end of the tape roll to contact the surface to which the length of tape was applied.

It is yet another object of the present invention to provide a tape dispenser which applies a desired length of a pressure sensitive adhesive tape to a surface without having to physically handle the tape which maintains positive control over the tape during use.

It is still another object of the present invention to provide a tape dispenser which applies a desired length of a pressure sensitive adhesive tape to a surface without having to physically handle the tape which dispenser is of simple construction and economical to manufacture.

These and other objects and advantages of the present invention will become readily apparent from the following detailed description taken in conjunction with the accompanying drawings.

IN THE DRAWINGS

DESCRIPTION OF THE PREFERRED EMBODIMENT

Figure 1:
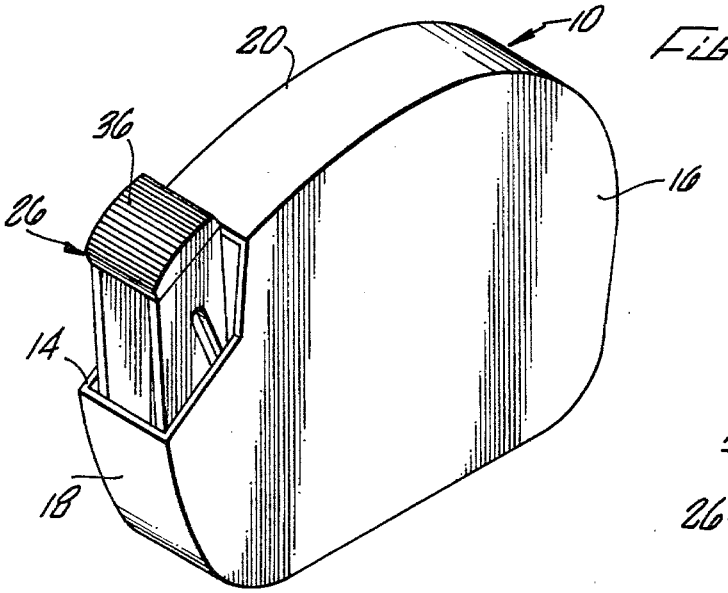
FIG. 1 is a perspective view of the tape dispenser of the present invention.
Figure 3:
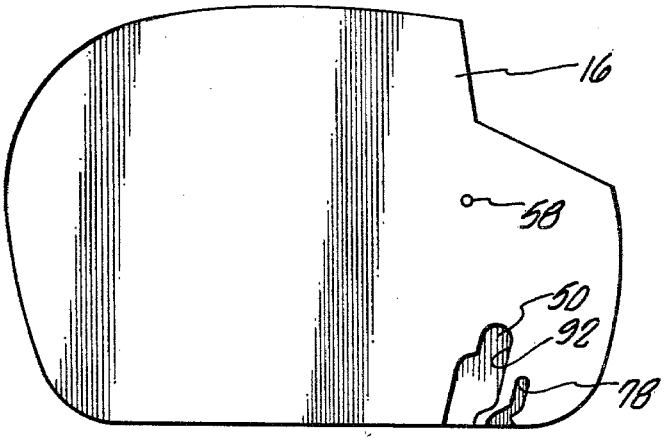
FIG. 3 is a side view of the removeable housing side wall.

Referring now in detail to the drawings, the preferred embodiment of the tape dispenser 10 of the present invention is comprised of a housing 12 having side walls 14 and 16; a forward wall 18, the lower portion of which defines a forward pressing surface 19; and a curvilinear top and rear wall 20 extending between the side walls from the base 22 of the housing about the rear portion thereof to a point 24 spaced from the elongated applicator element 26. A roll of pressure sensitive adhesive tape 28 is supported within the housing on a support element 30 carried by side wall 14. Side wall 14 also carries a stop 32 for leaf spring 34 and an inclined guide wall 35. Side wall 14 is seen in FIGS. 4–7, while side wall 16 is illustrated solely in FIGS. 1 and 3. If desired, side wall 16 can be made removeable from walls 18 and 20 for mounting a new tape roll in the housing.

The applicator element 26 defines an upper actuating button portion 36, leg extensions 38 and 40, a leaf spring stop 41 extending between the leg extensions and a tape support bar 42 extending between the lowermost extremities of the leg extensions. Protrusions 44 and 46 are provided on the leg extensions adjacent the lower ends thereof which extend laterally of the leg extensions and ride within guide channels 48 and 50 cut in side walls 14 and 16. The upper ends of protrusions 44 and 46 are curvilinear to facilitate upward movement of the protrusions within the guide channels and, in the preferred embodiment, the lower ends thereof carry the support bar 42 therebetween. Guide slots 52 and 54 are provided in the upper portions of the leg extensions which receive guide pins 56 and 58 carried by and extending inwardly of side walls 14 and 16. The guide pins 56 and 58 riding within slots 52 and 54 and the lateral protrusions 44 and 46 riding within channels 48 and 50 direct the movement of the applicator element 26 within the dispenser housing 12 in a manner which will be described.

A "U"-shaped tape gripping member 60 is pivotally mounted in the lower portion of the applicator element 26 forwardly of the tape support bar 42 by means of pins 62 and 64 extending laterally from the leg portions 61 and 63 of the tape gripping member 60 through slots 66 and 68 in the lower portion of the leg extensions of the actuator element 26. For reasons which will become apparent, slots 66 and 68 are of a kidney-shaped configuration. The tape gripping member 60 also defines a gripping bar 70 which extends between the leg portions thereof and has guide pins 72 and 74 extending laterally from the ends thereof. Guide pins 72 and 74 ride within a second set of guide channels 76 and 78 located in the side walls 14 and 16 of the housing forwardly of guide channels 48 and 50. In an effort to further reduce the cost of manufacture, it has been found that successful operation of the dispenser can be obtained through the use of only a single guide pin 74 on tape gripping bar 70 extending into guide channel 78 in side wall 16 of the housing, thereby eliminating guide pin 72 and channel 76. The movement of the tape gripping member 60 is directed by the vertical movement of the actuator element 26 by means of guide pins 72 and 74 and the path defined by the guide channels 76 and 78 in the side walls of the housing.

The lower end of the front wall 18 of the housing defines a tape cutting edge 80 which preferably tapers rearwardly and upwardly toward side wall 14 at an angle of about 1 degree and terminates in a pointed tape cutting tooth 84 (see FIGS. 7–9) which is disposed about 0.002 inches above pressing surface 19 defined by the underside of the forward housing wall 18. Correspondingly, and for reasons to be explained, the rearward edge 85 of the tape gripping bar 70 and the forward edge 87 of the tape support bar 42 taper outwardly from side wall 14 to side wall 16 at an angle from about two to five degrees.

Figure 4:
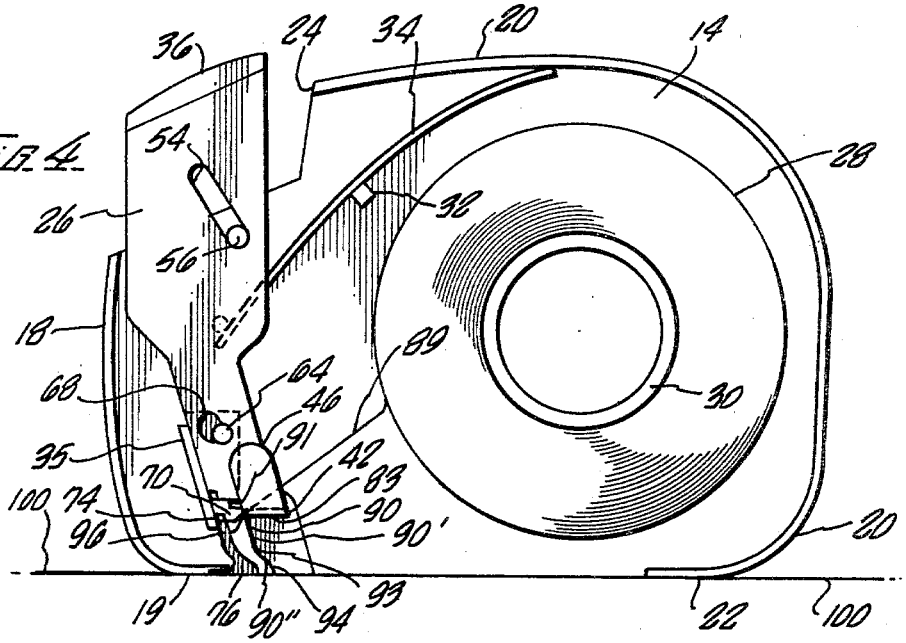
FIGS. 4–7 are partial side views of the tape dispenser with a side wall removed illustrating the movement of the dispenser elements as the tape is applied to a surface and severed from the tape roll.

The operation of the tape dispensing device 10 is illustrated in FIGS. 4–11. In FIG. 4, the device is shown ready for use for adhering a length of tape to a surface 100. As seen therein, a portion 89 of the end of the tape roll 28 is pulled from the roll and extended between the tape support bar 42 at the lower end of the applicator element 26 and the tape gripping bar 70 of the pivotally mounted gripping member 60. In this position, leaf spring 34 urges tape support bar 42 against the tape gripping bar 70, pressing the tape gripping member against guide wall 35 thereby pinching the tape between the tape support bar and tape gripping member. The forward edge 87 of the tape support bar 42 and the rearward edge 85 of the tape gripping bar 70 between which the tape is held, each define mating angles of about 45 degrees.

Figure 2:
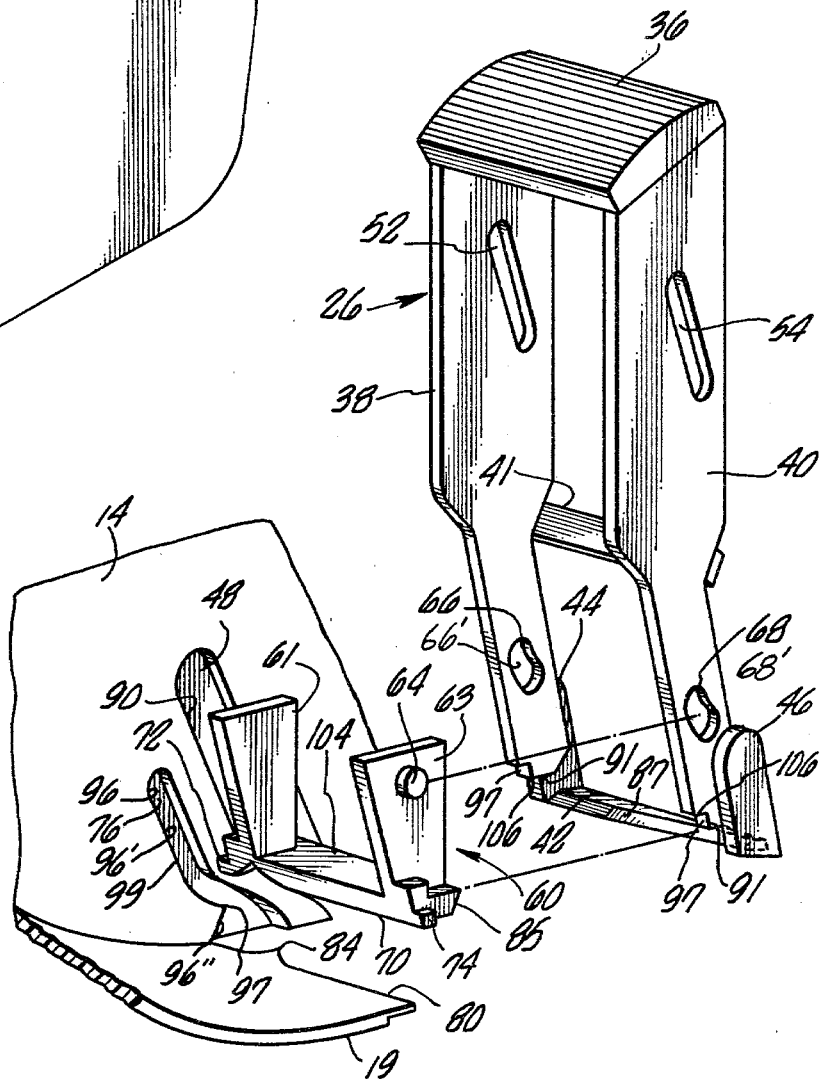
FIG. 2 is a partial exploded perspective view illustrating certain of the elements of the tape dispenser of the present invention with the guide bar removed for clarity.

To apply the tape to surface 100, the applicator element 26 is depressed downwardly until the underside 74 of the tape gripping bar 70 presses the tape against surface 100, whereupon the device is moved over the surface 100 adhering the desired length of the tape to that surface. The actuator element is then released, severing the length of tape and returning the severed end 88 of the tape roll into the device. As the applicator element 26 moves downwardly, horizontal pressing surfaces 91 which are located on the leg extensions 38 and 40 of the actuator element forwardly and slightly above the tape support bar 42, abut and move the tape gripping member 60 downwardly with the applicator element. The downward movement of the actuator element is directed by the guide surfaces 90 and 92 defined by the forward wall of guide slots 48 and 50 in the housing side walls 14 and 16. As guide surfaces 90 and 92 are identical in configuration, reference will be made solely to guide surface 90 and protrusion 42 on the actuator element which bears against guide surface 90. As best seen in FIG. 4, guide surface 90 defines a steep incline portion 90' which makes an angle of about 15 degrees with respect to the vertical and terminates at 93 into a less steeply inclined portion 90'' of about 55 degrees, turns downwardly at 94 and is open at its lowermost end. As the actuator element moves downwardly along the path dictated by guide surface 90, the tape gripping member 70 follows a downward path directed by guide or camming surfaces 96 and 98 defined by the forward walls of guide channels 42 and 54 in the housing side walls 14 and 16. Referring only to guide surface 96, it can be seen in FIG. 2 that guide surface 96 defines a steep inclined portion 96' which terminates at 99 into a less steep incline portion 96', which in turn terminates in a sharp ninety degree turn at 97 and extends forwardly therefrom along undercut portion 96''. Portions 96' and 96'' on guide surfaces 96 and 98 are of the degree of incline as portions 90' and 90'' on guide surfaces 90 and 92. As the gripping member 60 is pivotally mounted on the actuator element, the applicator element and tape gripping member are free to move relative to one another in the manner dictated by guide surfaces 90 and 92 and 96 and 98.

As the applicator element 26 is moved downwardly within the housing under manual pressure being exerted on the upper end 36 thereof, the applicator is caused to move rearwardly within the housing when the protrusions 44 and 46 thereon reach surface 90' of camming surfaces 90 and 92 whereupon the tape support bar 42 no longer presses the tape gripping member 60 against guide surface 96 allowing the tape gripping member to pivot slightly clockwise thereby releasing the tape previously pinched therebetween. In this position, the adhesive on the tape secures the tape to the tape support bar 42.

Figure 5:
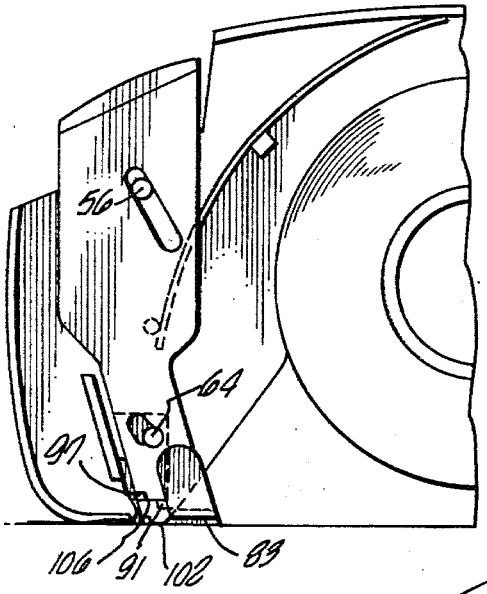
Figure 8:
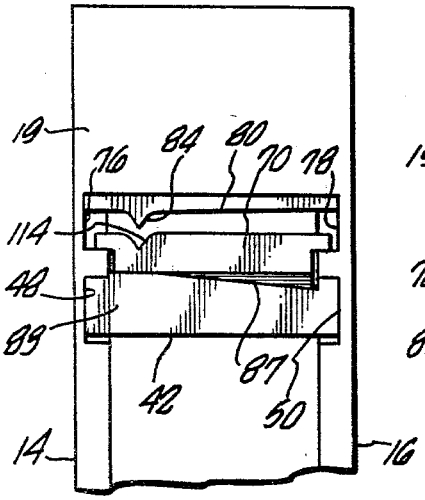
FIGS. 8–10 are bottom views of a portion of the dispenser illustrating the relative positioning and operation of the tape handling and shearing elements.

As the actuator element 26 continues downwardly, its rearward movement substantially ceases due to the steep incline in the lower portion 90'' of guide surfaces 90 and 92. At this stage which is illustrated in FIG. 5, the underside 99 of the tape gripping bar 70 presses the tape end 102 against surface 100. The relative positioning of the undersides of the tape support and tape gripping bars 42 and 70 at this point of the operation are illustrated in FIG. 8. The tape dispenser 10 is then moved over the surface 100 pressing the tape dispenser against the surface and the pressure exerted causing the tape to pay out of the dispenser and adhere to surface 100.

Figure 6:
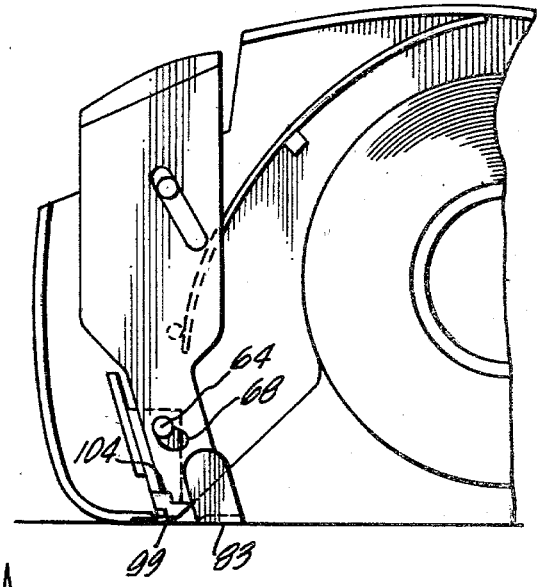

When the desired length of tape has been paid out, the actuator element 26 is released and the leaf spring 34 causes the actuating element to return to its raised position. As the actuator element begins its upward movement, the tape gripping member 60 has already been pivoted to its forwardmost position (See FIGS. 6 and 9) by the pressure exerted thereon by the tape as the tape was being paid out of the dispenser. In addition to moving the tape gripping member 60 to its forward position, the tape gripping member is forced upwardly by the tape into recessed area 97 in the actuator element 26 as soon as the upper rearward edge 104 of tape gripping bar 70 clears the forward edge 106 of horizontal pressing surface 91. Note the relative shift of position of pin 64 on the tape gripping member 60 in slot 68 in the activating element 26 as seen in FIGS. 4 and 6. It should be noted that when the tape gripping bar 70 is moved into recessed area 97, the underside 83 of the tape support bar 42 is flush with the forward pressing surface 19 of the dispenser housing and with surface 100 for smooth application of the tape onto surface 100. Recessed area 97 is provided in the applicator element 26 to allow the tape gripping element to move upwardly so that the tape gripping bar 70 does not interfere with the smooth application of the tape to surface 100 and the subsequent severing thereof. It should also be noted that when the tape gripping member 70 moves upwardly into recess 97, the tape is not pinched between the tape support bar 42 and the tape gripping bar 70 thereby allowing the tape to freely move off the tape roll 28. Additionally, moving the tape gripping member 60 into recess 97 shortens the amount of tape extending from the point at which it is pinched between the tape support bar 42 and tape gripping bar 70 to the tape cutting edge 80 as the tape is pulled in a straight line and need not be extended around the lower portion of the tape gripping bar 70. By shortening the tape which must be paid out, the severed end 88 of the tape roll is prevented from coming into contact with surface 100 where it would pull fibers from the surface and greatly reduce its adhering ability adversely affecting the next application of tape.

Figure 7:
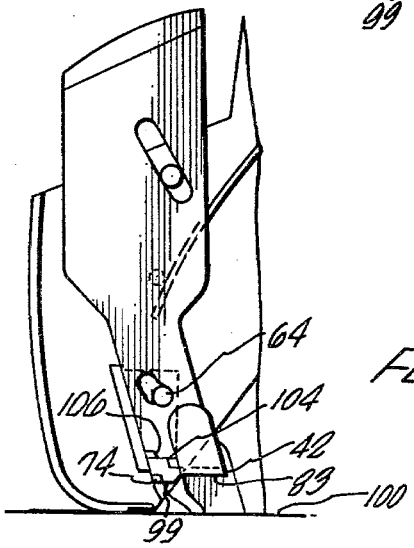

As the actuator element moves upwardly within the dispenser under the pressure exerted thereon by leaf spring 34, the slots 66 and 68 in which pins 62 and 64 respectively are disposed move upwardly with respect to the pins 62 and 64 until the lower end walls 66' and 68' of slots 66 and 68 abut the pins. At this point, end walls 66' and 68' begin to raise the tape gripping member 60 with the applicator element. Concurrently with the movement of the slots 66 and 68 about pins 62 and 64, guide pins 72 and 74 on the tape gripping member 60 move upwardly along guide surfaces 96 and 98 causing the tape gripping members 60 to move rearwardly and returning tape gripping bar 70 to a position below the horizontal pressing surface 91 of the actuator element 26. Lifting of the actuator element and tape guide member continues without any pinching contact of the tape between the tape gripping bar 70 and tape support bar 42 to avoid any premature gripping and consequential overextension of the tape from the tape roll until the tape gripping member abuts guide wall 35 extending from side wall 14 of the dispenser housing. At that point, the force of the leaf spring 34 causes the tape support bar 42 to again press the tape gripping member 70 against the guide wall 35 thereby again pinching the tape tightly between the tape gripping bar 70 and tape support bar 42 as seen in FIG. 7. The further lifting of the actuator element and the tape gripping bar causes the tape to be drawn across the cutting tooth 84 on cutting edge 80 defined by the lower rearward edge of the front wall housing 18, shearing the tape at 88.

Figure 9:
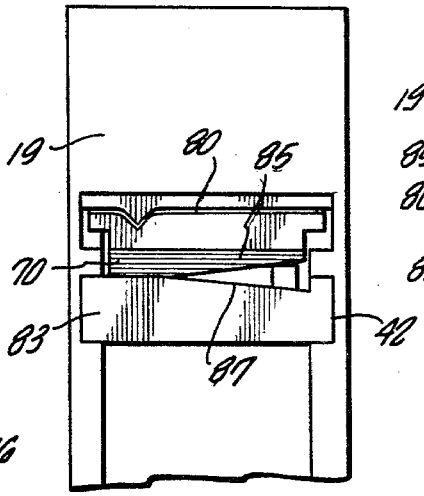
Figure 10:
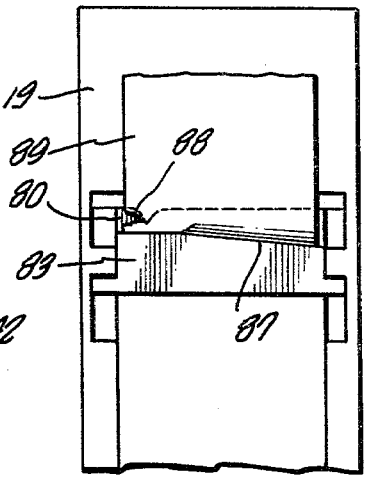
Figure 11:
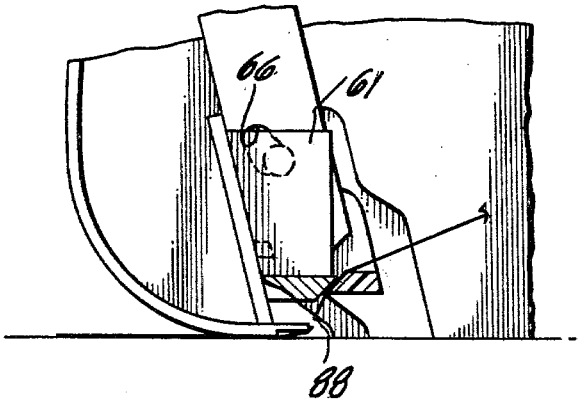
FIG. 11 is a side sectional view of the dispsenser illustrating the shearing of the tape.
Figure 12:
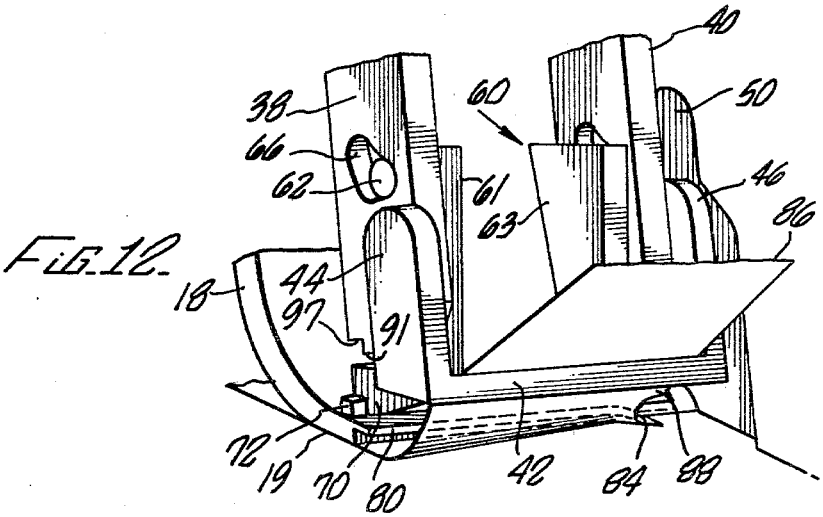
FIG. 12 is a partial perspective view of the dispenser illustrating the shearing of the tape.

The shearing of the tape is illustrated in FIGS. 10–12. As noted earlier, the cutting edge 80 has an upward and rearward taper about 1 degree into cutting tooth 84. (See FIGS. 8 and 9). This taper allows for a smooth shearing of the tape at 88. To further facilitate shearing of the tape, the rearward edge 85 of the tape gripping bar 70 and the forward edge 87 of the tape support bar 42 are tapered outwardly from side wall 16 to side wall 14 at an angle of about two to five degrees. This taper in the tape gripping surfaces, which is found in the preferred embodiment of the invention, allows the tape to be gripped not uniformally along the tape gripping and tape support bars, but only at the ends thereof adjacent side wall 14 (See FIG. 10). By gripping the tape at the point nearest the cutting tooth 84 and pulling the tape from that end, an easier and more natural shearing of the tape is achieved. Additionally, as is illustrated in somewhat exaggerated form in FIG. 12, the outward tapering of the gripping and support bars allows the tape to bow slightly outwardly therebetween, away from the cutting tooth, thereby allowing the tape to assume a natural disposition during the shearing thereof. It should also be noted that the tape gripping bar 70 is provided with a notch 114 to accommodate tooth 84 when the tape gripping bar is brought into an adjacent alignment with the cutting edge 80 for withdrawal of the tape as seen in FIG. 9.

After the tape is sheared, the applicator element 26 and tape gripping member 60 are returned to their uppermost position by leaf spring 34 and the device is ready to dispense another length of tape.

Various changes and modifications may be made in carrying out the present invention without departing from the spirit and scope thereof. Insofar as these changes and modifications are within the purview of the appended claims, they are to be considered part of the invention.

We claim:

1. A pressure sensitive tape dispenser comprising a housing, means for mounting a roll of pressure sensitive tape within said housing, a tape cutting member disposed within said housing, a manually operative applicator element slidably mounted within said housing, a tape support bar carried by said applicator element, a tape gripping member pivotally mounted within said housing and means for selectively biasing said tape support bar and said tape gripping member in a tape gripping relationship and for raising said applicator element within said housing such that tape can be freely drawn from said roll between said tape gripping bar and said tape gripping member, held therebetween and pulled thereby over said cutting member thereby severing the tape.

2. The combination of claim 1 wherein said tape gripping member is pivotally mounted on said applicator element for movement therewith and with respect thereto.

3. The combination of claim 2 wherein said selective biasing means comprises a spring member for urging said applicator element upwardly and forwardly within said housing, a first guide means for directing the movement of said applicator element as said element is slidably moved within said housing and a second guide means for directing the pivotal movement of said tape gripping member with respect to said applicator element.

4. A pressure sensitive tape dispenser comprising a housing, means for mounting a roll of pressure sensitive tape within said housing, a tape cutting member disposed within said housing, a manually operative applicator element slidably mounted within said housing, a tape support bar carried by said applicator element, a tape gripping member defining a tape gripping bar, said tape gripping member being mounted for pivotal and limited linear movement on said applicator element such that said tape gripping bar is disposed forwardly and substantially parallel with said tape support bar, biasing means for urging said applicator element upwardly within said housing, and guide means for directing said tape gripping bar from said tape support bar as said applicator element is moved downwardly within said housing thereby allowing tape to be withdrawn from said housing and, upon said applicator element being raised by said biasing means, for directing said tape suppport bar against said gripping bar for gripping said tape therebetween and pulling said tape over said cutting member thereby severing said tape from the tape roll.

5. The combination of claim 4 wherein said tape gripping member is of a "U"-shaped configuration defining upstanding leg portions and tape gripping bar extending therebetween, said upstanding leg portions being mounted on said tape applicator element.

6. The combination of claim 4 wherein said guide means comprises a first guide surface, a first guide member carried by said applicator element and bearing against said first guide surface, a second guide surface disposed forwardly in said housing of said first guide surface and a second guide member carried by said tape gripping member, said tape gripping bar and said tape support bar being pivoted into and out of tape gripping engagement as said first and second guide members are moved along said first and second guide surfaces.

7. The combination of claim 6 wherein said applicator element includes a relief area disposed forwardly of and above said tape support bar such that upon said tape being pulled from said housing, said tape gripping bar is moved forwardly and upwardly into said relief area by said tape.

8. A pressure sensitive tape dispenser comprising a housing, means for mounting a roll of pressure sensitive tape within said housing, a tape cutting member disposed within said housing, an applicator element slidably mounted within said housing, said element including depending leg portions and a tape support bar extending therebetween, a "U"-shaped gripping member defining upstanding leg portions and a tape gripping bar extending therebetween, said upstanding leg portions being mounted for pivotal and limited linear movement on the depending leg portions of said applicator element such that said tape gripping bar is disposed forwardly of and substantially parallel with said tape support bar within said housing, biasing means for urging said applicator element upwardly and forwardly within said housing, and guide means for directing said tape gripping bar from said tape support bar as said applicator element is moved downwardly within said housing thereby allowing tape to be withdrawn from said housing and, upon said applicator element being raised by said biasing means, for directing said tape support bar against said gripping bar for gripping said tape therebetween and pulling said tape over said cutting member thereby severing said tape from the tape roll.

9. The combination of claim 8 wherein said guide means comprises a first guide surface, a first guide member carried by said applicator element and bearing against said first guide surface, a second guide surface disposed forwardly in said housing of said first guide surface and a second guide member carried by said tape gripping member, said tape gripping bar and said tape support bar being pivoted into and out of tape gripping engagement as said first and second guide members are moved along said first and second guide surfaces.

10. The combination of claim 8 wherein said applicator element includes a relief area disposed forwardly of and above said tape support bar such that upon said tape being pulled from said housing, said tape gripping bar is moved forwardly and upwardly into said relief area by said tape.

11. The combination of claim 8 wherein said housing includes a forward wall portion, said tape cutting member being defined by the end of said forward wall portion and including a rearwardly projecting pointed tooth member and a tape cutting surface extending laterally therefrom and substantially parallel with said tape gripping bar and said tape support bar.

12. The combination of claim 11 wherein said cutting surface tapers outwardly from said projecting tooth member at an angle of about 1 degree with respect to the central axis of said tape gripping bar.

13. The combination of claim 11 wherein said tape support bar defines a forward tape gripping surface and said tape gripping bar defines a rear gripping surface, said surfaces each diverging from the ends thereof adjacent said cutting tooth at angles of about two to five degrees to facilitate the bowing of tape therebetween during the cutting of said tape by said cutting member.

* * * * *